United States Patent [19]

Korenberg

[11] Patent Number: 4,860,695

[45] Date of Patent: Aug. 29, 1989

[54] CYCLONE COMBUSTION APPARATUS

[75] Inventor: Jacob Korenberg, York, Pa.

[73] Assignee: Donlee Technologies, Inc., York, Pa.

[21] Appl. No.: 44,735

[22] Filed: May 1, 1987

[51] Int. Cl.[4] ..... F22B 7/00; F22B 31/02

[52] U.S. Cl. ..... 122/136 R; 122/149; 122/153

[58] Field of Search ..... 122/14–17, 122/4 D, 367 R, 367 A, 49, 166 R, 74, 153, 182 R, 136 R, 149; 110/264, 265, 244

[56] References Cited

U.S. PATENT DOCUMENTS

| | | | |
|---|---|---|---|
| 1,535,886 | 4/1925 | Zulver . | |
| 1,679,830 | 8/1928 | Lang . | |
| 1,864,601 | 6/1932 | Lord | 122/74 |
| 1,933,229 | 10/1933 | Stacey | 122/74 |
| 1,934,021 | 11/1933 | Wafter | 122/74 |
| 2,465,675 | 3/1949 | DeLancey | 431/265 |
| 2,499,207 | 2/1950 | Wolfersperger | 431/158 |
| 2,800,091 | 2/1952 | Lotz et al. | 110/28 |
| 3,048,215 | 8/1962 | Huckabee | 158/113 |
| 3,173,499 | 3/1965 | Ross | 431/158 |
| 3,273,621 | 9/1966 | Childree | 158/7 |
| 3,376,098 | 4/1968 | Pryor | 431/10 |
| 3,974,021 | 8/1976 | Bernadiner et al. | 159/4 A |
| 3,998,581 | 12/1976 | Hemingway | 431/158 |
| 4,003,692 | 1/1977 | Moore | 431/158 |
| 4,154,567 | 5/1979 | Dahmen | 431/5 |
| 4,218,426 | 8/1980 | Dahmen | 423/210 |
| 4,240,784 | 12/1980 | Dauvergne | 431/351 |
| 4,245,980 | 1/1981 | Reed et al. | 431/351 |
| 4,260,367 | 4/1981 | Markowski | 431/353 |
| 4,409,926 | 10/1983 | Moore | 122/4 D |
| 4,434,723 | 3/1984 | Brealey et al. | 122/4 D |
| 4,457,289 | 7/1984 | Korenberg | 122/4 D |
| 4,565,137 | 1/1986 | Wright | 110/265 |
| 4,624,191 | 11/1986 | Zauderer et al. | 110/265 |
| 4,671,192 | 6/1987 | Hoffert et al. | 110/265 |

FOREIGN PATENT DOCUMENTS

| | | | |
|---|---|---|---|
| 1200505 | 12/1968 | United Kingdom | 122/149 |

OTHER PUBLICATIONS

Hazardous Waste Disposal by Thermal Oxidation, John Zink Company, Tulsa, Okla., (undated).

Combustion in Swirling Flow: A Review, N. Syred and J. M. Beer, Combustion Flame, vol. 23, pp. 143–210 (1974).

*Primary Examiner*—Albert J. Makay

*Attorney, Agent, or Firm*—Finnegan, Henderson, Farabow, Garrett & Dunner

[57] ABSTRACT

A cyclone combustion apparatus includes a combustion chamber having a substantially cylindrical wall, a substantially cylindrical exit throat at the rear end of the combustion chamber, means for supplying partially preburned fuel into the combustion chamber at a front end thereof, means for supplying secondary air into the combustion chamber and for forming a cyclonic flow pattern of hot gases for combustion within the chamber, and heat exchange means surrounding and extending throughout the axial length of the combustion chamber. The apparatus may also include a substantially cylindrical cooling chamber extending beyond the exit throat from the rear end of the combustion chamber and substantially longitudinally aligned with the combustion chamber. The combustion chamber, the exit throat and the annular secondary air supply opening are dimensioned and configured to effect a cyclonic flow pattern in the combustion chamber.

28 Claims, 8 Drawing Sheets

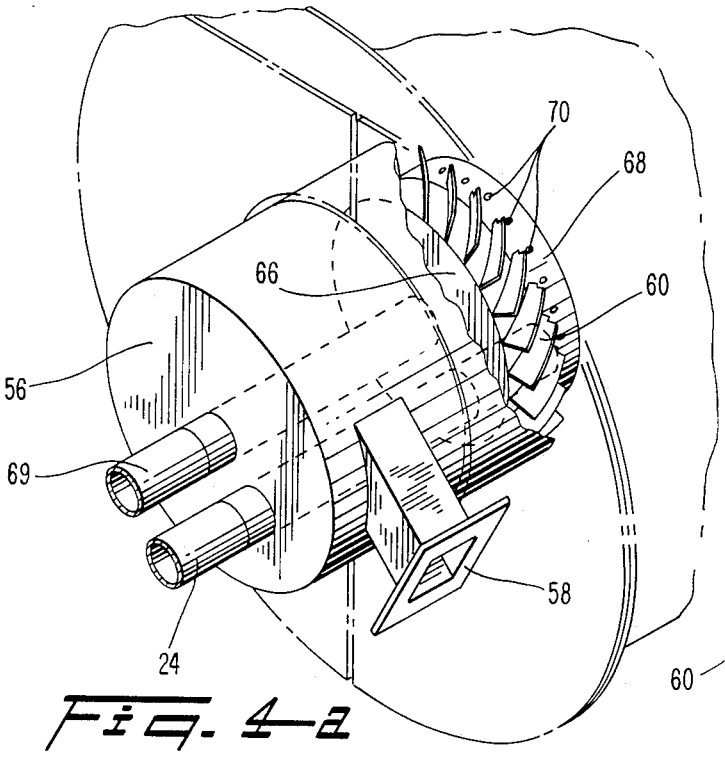
Fig. 4-a
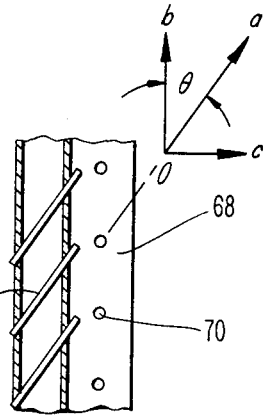
Fig. 4-d
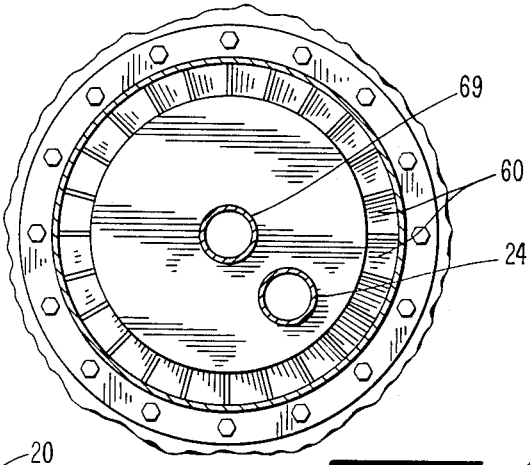
Fig. 4-c
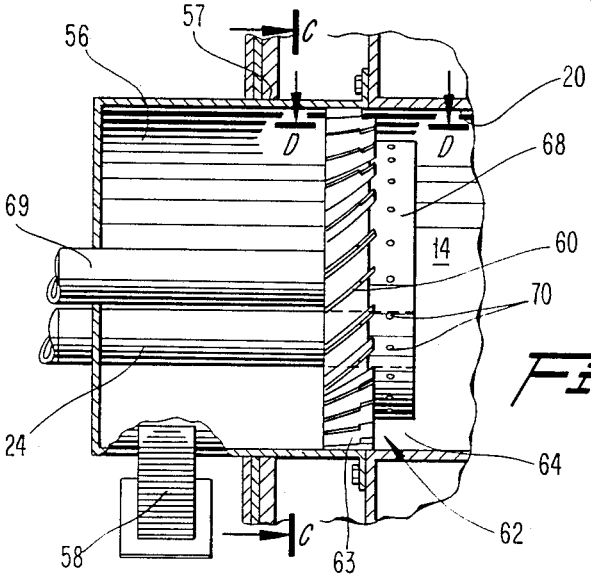
Fig. 4-b

Fig. 7
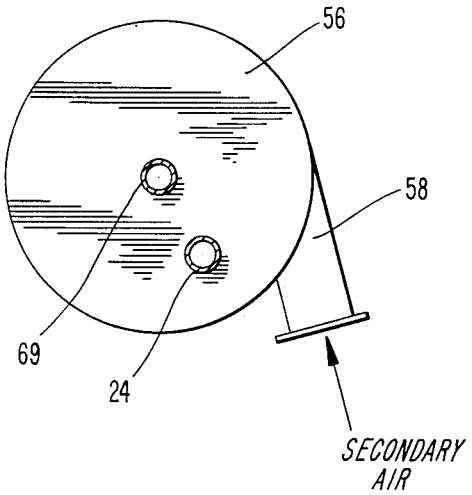
Fig. 11
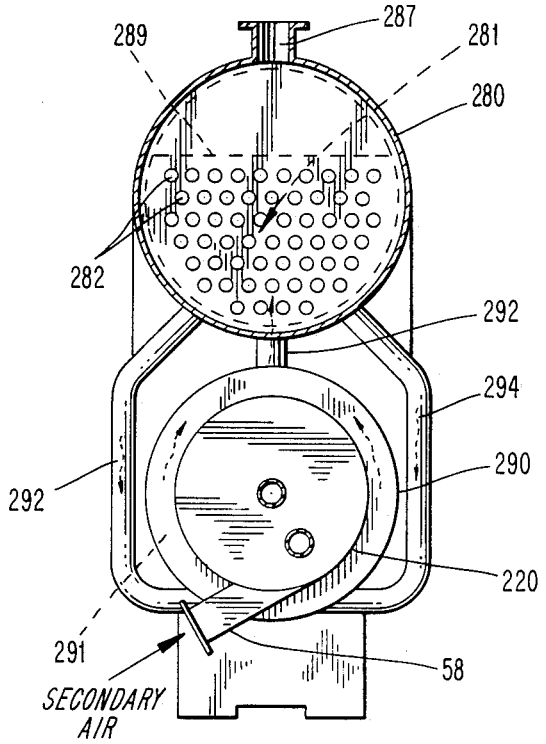
Fig. 8
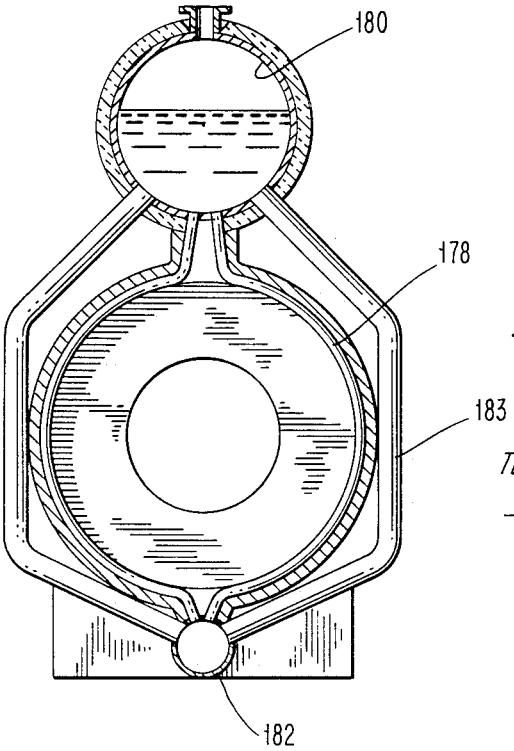
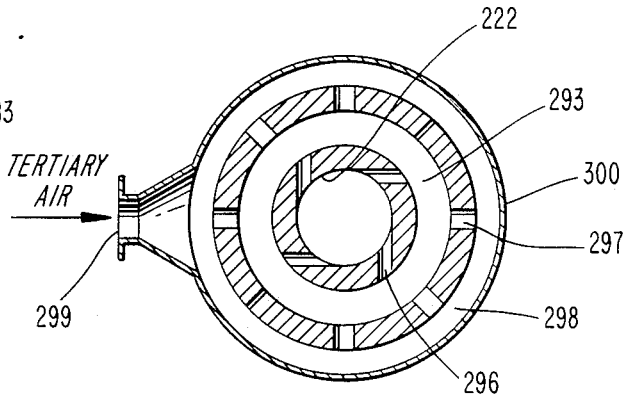
Fig. 13

CYCLONE COMBUSTION APPARATUS

BACKGROUND OF THE INVENTION

1. Field of the Invention

The present invention relates to a cyclonic combustion apparatus, and more particularly to a combustion apparatus that enables high specific heat release while producing exhaust gases with low concentrations of nitrogen oxide, commonly known as $NO_x$, and of other exhaust gases.

2. Description of the Related Art

In the past, cyclone combustion chambers have been used to produce a cyclone of turbulent gases within a combustion chamber for combusting various solid materials, including poor quality coal and vegetable refuse. Such combustors are disclosed in "Combustion and Swirling Flows: A Review", N. Syred and J. M. Beer, Combustion and Flame, Volume 23, pages 143–201 (1974). A fluidized bed boiler having a cyclonic combustor is disclosed in U.S. Pat. No. 4,457,289 to Korenberg. These documents are incorporated by reference in this application. A fire tube boiler having a cyclonic combustor was commercially marketed by Cyclotherm Division, Oswego Package Boiler Co., Inc.

Although known adiabatic cyclone combustors provide high specific heat release, such known combustors have the disadvantage that combustion temperature is high and $NO_x$ emissions are high. In conventional cyclone combustors, combustion is unstable at low capacity burning and high turndown ratios are not possible in non-adiabatic combustors.

The turndown ratio of a combustion apparatus in a boiler is defined as the ratio of maximum load to minimum load and measures the ability of the boiler to operate over the extremes of its load ranges. A high turndown ratio allows for a wide range in the level of steam generation at a particular time. A wide range of steam generation is important to allow the boiler to most efficiently respond to varying steam demands.

Stable combustion can be achieved by not cooling the walls of a cyclone combustion chamber in the portion of the chamber into which air and fuel are injected for combustion, as is disclosed in United States Patent Application Serial Number 928,096, filed Nov. 7, 1986 and assigned to a common assignee, which is incorporated by reference in this application. High wall temperatures near the chamber fuel and air entrance enable a high turndown ratio to be achieved. For example, by incorporating uncooled refractory lined walls at the air and fuel entrance to the combustion chamber, the turndown ratio can be increased from 4:1 up to and higher than 10:1. With such an arrangement, excess air over that required as a combustion reactant, can be decreased from 25–30% to about 5% and kept constant at about 5% over the turndown ratio of 10:1. In addition the flame temperature can be decreased from about 3000° F. for conventional fire tube boilers to about 2000° F. By lowering the excess air and by lowering the flame temperature, $NO_x$ emission concentrations are lowered in the flue exhaust.

With pollution control requirements becoming constantly more stringent, it is necessary to decrease $NO_x$ emissions even further than is achieved with the combustion apparatus described above, while not increasing or while even decreasing the cost of the combustion equipment.

It is an object of the present invention to provide a cyclone combustion apparatus having a very high specific heat release, that can operate at relative low combustion temperatures and with a relatively low percentage of excess air so as to produce low carbon monoxide emissions, commonly known as CO, and very low $NO_x$ emissions.

It is also an object of the invention to provide a cyclone combustion apparatus that enables stable combustion and a high turndown ratio and that does not require refractory lined walls at the entrance of the combustion chamber.

It is another object of the present invention to provide a cyclone combustion apparatus capable of stable combustion at relatively low flame temperatures that may be produced at a reduced cost.

Additional objects and advantageous of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the invention as embodied and broadly described herein, there is provided a cyclone combustion apparatus comprising a combustion chamber having a front end, a rear end and a substantially cylindrical wall having an inner surface; a substantially cylindrical exit throat at the rear end of the combustion chamber and aligned substantially concentrically therewith for exhausting hot gases from the combustion chamber, the exit throat having a diameter less than the diameter of the inner surface; means for supplying partially preburned fuel into the combustion chamber from the front end thereof; means for supplying secondary air into the combustion chamber and for forming a cyclonic flow pattern of hot gases for combustion within the chamber; and heat exchange means surrounding and extending substantially throughout the axial length of the combustion chamber for substantially cooling the wall of the combustion chamber.

BRIEF DESCRIPTION OF THE DRAWINGS

The accompanying drawings, which are incorporated in and constitute a part of the specification, illustrate preferred embodiments of the invention and, together with the general description given above and the detailed description of the preferred embodiments given below, serve to explain the principles of the invention.

FIG. 4(*a*) is a broken away view in perspective of the front end of the boiler illustrated in FIG. 1;

FIG. 4(*b*) is a side elevational view of the front end of the boiler shown in FIG. 4(*a*);

FIG. 4(*c*) is a cross-sectional view taken along the line C—C of FIG. 4(*b*);

FIG. 4(*d*) is a partial cross-sectional view taken along the line D—D of FIG. 4(*b*);

FIG. 7 is a front end view of the boiler illustrated in FIG. 6;

FIG. 8 is a cross-sectional view taken along the line VIII—VIII of FIG. 6;

FIG. 11 is a cross-sectional view taken along the line XI—XI of FIG. 10;

FIG. 13 is a cross-section view taken along the line XIII—XIII of FIG. 12.

DESCRIPTION OF THE PREFERRED EMBODIMENT

Figure 1:
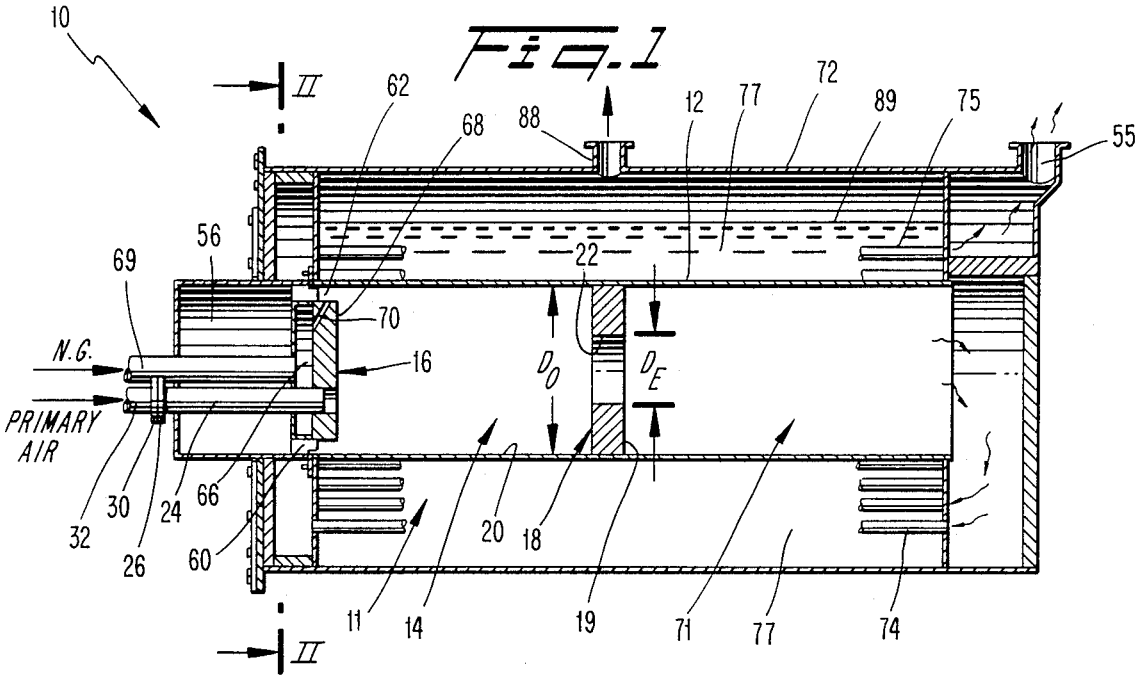
FIG. 1 is a side elevation in cross-section of a first embodiment of a fire tube boiler incorporating the teachings of the present invention.

Reference will now be made in detail to the present preferred embodiments of the invention as illustrated in the accompanying drawings. Throughout the drawings, like reference characters are used to designate like elements.

In accordance with the invention, there is provided a cyclone combustion apparatus comprising a combustion chamber having a front end, a rear end and a substantially cylindrical wall having an inner surface; a substantially cylindrical exit throat at the rear end of the combustion chamber and aligned substantially concentrically therewith for exhausting hot gases from the combustion chamber, the exit throat having a diameter less than the diameter of the inner surface; means for supplying partially preburned fuel directly into the combustion chamber from the front end thereof; means for supplying secondary air into the combustion chamber and for forming a cyclonic flow pattern of hot gases for combustion within the chamber; and heat exchange means surrounding and extending substantially throughout the axial length of the combustion chamber for cooling the wall of the combustion chamber.

FIG. 1 shows a horizontally disposed fire tube boiler 10 having a cyclonic combustion apparatus 11 in accordance with one preferred embodiment of the invention. Apparatus 11 includes a central fire tube also known as a Morison tube 12, with a combustion chamber 14. Chamber 14 includes a front end 16, a rear end 18 and a substantially cylindrical longitudinally extending outer wall 20.

A substantailly cylindrical exit throat 22 in a rear end wall 19 is positioned at rear end 18 of combustion chamber 14 and is aligned substantially concentrically therewith, for exhausting hot gases from combustion chamber 14. Exit throat 22 has a diameter less than the diameter of the inner surface of wall 20 of chamber 14. The ratio of the diameter of exit throat 22 (De) to the diameter of the inner surface of wall 20 of chamber 14 (Do), i.e., De/Do, is preferably within the range of about 0.4 to about 0.7 in order to achieve the desired cyclonic air flow within combustion chamber 14. Rear end wall 19 is preferably comprised of a refractory material.

Figure 1A:
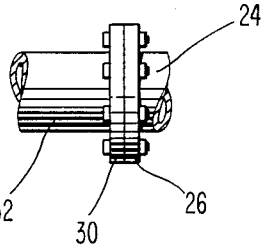
FIG. 1*a* is an enlarged side elevational view of a flanged joint in the fire tube boiler shown in FIG. 1.
Figure 5:
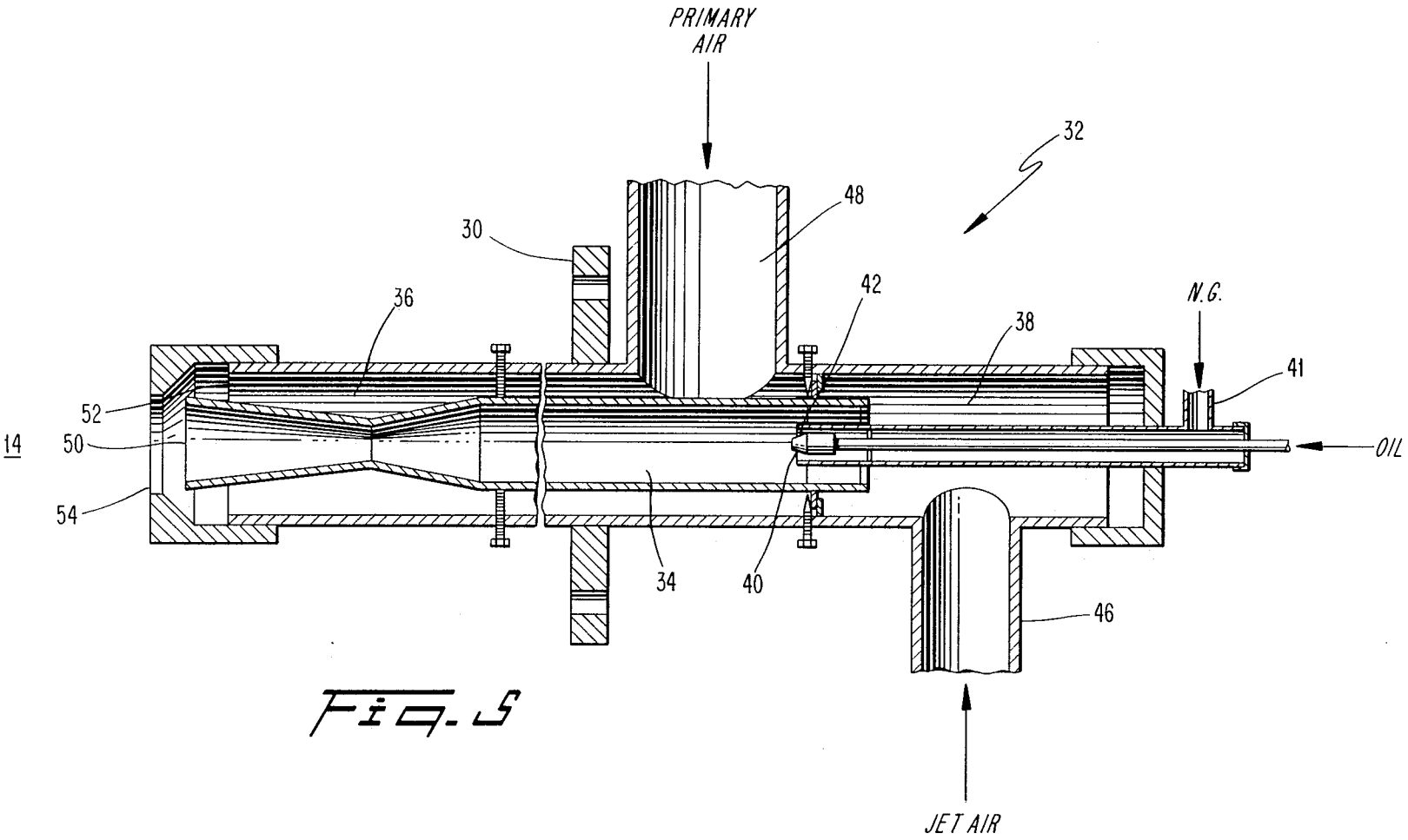
FIG. 5 is an enlarged side elevation view in cross-section of a jet burner/vaporizer in inlet pipe 24 of FIG. 1.

Means for supplying partially preburned fuel directly into the combustion chamber from the front end thereof are provided. As embodied herein, such means include a first fuel inlet pipe 24 having a flange 26 and a jet burner 32 having a flange 30 connected to flange 26. Joined flanges 26 and 30 are best shown in FIG. 1*a*. Jet burner 32 is in communication with front end 16 of combustion chamber 14. As shown in FIG. 5, jet burner 32 includes a precombustion chamber 34, a jet air chamber 38, and an annular air chamber 36. Fuel oil enters precombustion chamber 34 through a fuel nozzle 40 when liquid fuel is burned. When natural or other gas is burned, the fuel enters precombustion chamber 34 through an annular space 42 around nozzel 40. Upon entering precombustion chamber 34, the fuel burns with jet air supplied from jet air chamber 38 through a jet air supply inlet 46. The jet air supply and fuel supply are controlled to achieve a desired air-fuel mixture in the precombustion chamber. Primary air is supplied through a primary air supply inlet 48 into annular air chamber 36 which annularly surrounds precombustion chamber 34. Precombustion chamber 34 is heated by partial burning of the fuel. The outside surfaces of the precombustion chamber are cooled by primary air passing through annular air chamber 36.

The partially preburned fuel enters combustion chamber 14 through an outlet 50 of precombustion chamber 34 in an end 54 of jet burner 32. An annular air chamber outlet 52 discharges the heated primary air stream in a flow pattern surrounding the partially preburned fuel entering combustion chamber 14 from precombustion chamber 34. The partially preburned fuel from precombustion chamber 34 undergoes further burning when it comes in contact with the primary air supply. Jet burner 32 is disclosed in detail in U.S Pat. Application Ser. No. 044,733 entitled Jet Burner and Vaporizer Method and Apparatus filed May 1, 1987 with this application and assigned to a common assignee, which is incorporated by reference.

Means for supplying secondary air into combustion chamber 14 and for forming a cyclonic flow pattern of hot gases for combustion within the chamber are provided. As embodied herein and as shown in FIG. 1, such means include an air plenum chamber 56, an annular air supply opening 62 and a plurality of spaced radial vanes 60. Air plenum chamber 56 is coaxially situated on front end 16 of combustion chamber 14. Air plenum 56 has an air inlet 58 (FIG. 3) which injects secondary air into plenum 56 and which is preferably tengentially aligned to plenum 56 in order to facilitate the air entrance into plenum 56 and minimize air pressure drop.

Plenum 56 communicates with annular air supply opening 62 and is preferably coaxially aligned with combustion chamber 14, as shown in FIGS. 4(*a*)-(*d*). Annular air supply opening 62 has an outer diameter that is substantially equal to the diameter of the inner surface of wall 20 of combustion chamber 14. As shown in FIG. 4(*b*), opening 62 includes a first annular segment 63 having an inner wall defined by a circumferential wall of a gas distribution plenum chamber 66 and having an outer wall defined by a portion of a wall 57 of air plenum chamber 56. Opening 62 further includes a second annular segment 64 having an inner wall defined by an outer circumferential surface of an end plate 68 at front end of chamber 14 and having an outer wall defined by a portion of cylindrical wall 20 of chamber 14.

The diameters of the inner and outer walls of first annular segment 63 and second annular segment 64 are substantially equal. A plurality of spaced radial vanes 60 are provided in first segment 63 of annular air supply opening 62. Radial vanes 60 are tilted at a selected angle $\sigma$ from the normal axis of combustion chamber 14, as is best shown in FIGS. 4(*b*) and (*d*). Decreasing the selected angle $\sigma$ between the vanes 60 and the normal axis of combustion chamber 14 has the effect of increasing the anglular velocity, at a given combustion chamber cross-sectional area and air flow, of air entering combustion chamber 14 through annular air supply opening 62. Angle $\sigma$ is preferably in the range of about 20° to about 30°. Secondary air entering combustion chamber 14 has a swirling flow pattern due to the selected angle $\sigma$ of vanes 60 for generating air swirling in combustion chamber 14.

According to one preferred embodiment of the invention, means for injecting gaseous fuel immediately adjacent annular air opening 62 are provided. As embodied herein such means include a gas inlet pipe 69, gas distribution plenum chamber 66 and a plurality of gas nozzles 70. Gas distribution plenum chamber 66 is provided on front end 16 of combustion chamber 14 between combustion chamber 14 and air plenum chamber 56. Gas inlet pipe 69 communicates with gas distribution plenum chamber 66 for supplying plenum chamber 66 with gas. A plurality of gas nozzles 70 communicate gas distribution plenum chamber 66 with annular air supply opening 62. Gas nozzles 70 extend through end plate 68 that is positioned between combustion chamber 14 and gas distribution plenum chamber 66 and is comprised of refractory material. A plurality of spaced nozzles 70, as shown in FIGS. 4(*a*), (*b*) and (*d*), have outlets for discharging gas around the complete outer circumference of plate 68. Inlet pipe 69 may be used to supply gas into gas distribution plenum chamber 66 and into annular air supply opening 62 at operating capacities of the cyclonic combustion apparatus that are greater than or optionally equal to the minimum capacity of the apparatus. Gas is always supplied to gas port 41 of jet burner 32 (FIG. 5) regardless of apparatus operating level.

Combustion chamber 14, exit throat 22, annular air supply opening 62 and vanes 60 are dimensioned and configured to effect a cyclonic flow pattern of hot gases for combustion within combustion chamber 14, having a Swirl Number [defined in terms of combustor input and exit parameters as S=(Input Axial Flux of Angular Momentum)/(De/2×Exit Axial Flux of Linear Momentum), where De is the combustor exit throat diameter] of at least 0.6 and a Reynolds Number of at least 18,000 when the chamber is operated at full capacity. Chamber 14 will, during operation, exhibit large internal reverse flow zones with as many as three concentric toroidal recirculation zones being formed. Such recirculation zones are known generally in the field of conventional cyclone combustors. It is the cyclone turbulence which enables the achievement of specific heat release values up to and higher than $3.5\times10^6$ Kcal per cubic meter per hour and that contributes to reduced $NO_x$ concentrations in flue gases, the $NO_x$ concentrations being lower than 50 ppm per million BTU of burned input fuel. This coupled with the high level of turbulence results in significantly improved heat exchange and, therefore a relatively uniform temperature throughout combustion chamber 14.

Figure 6:
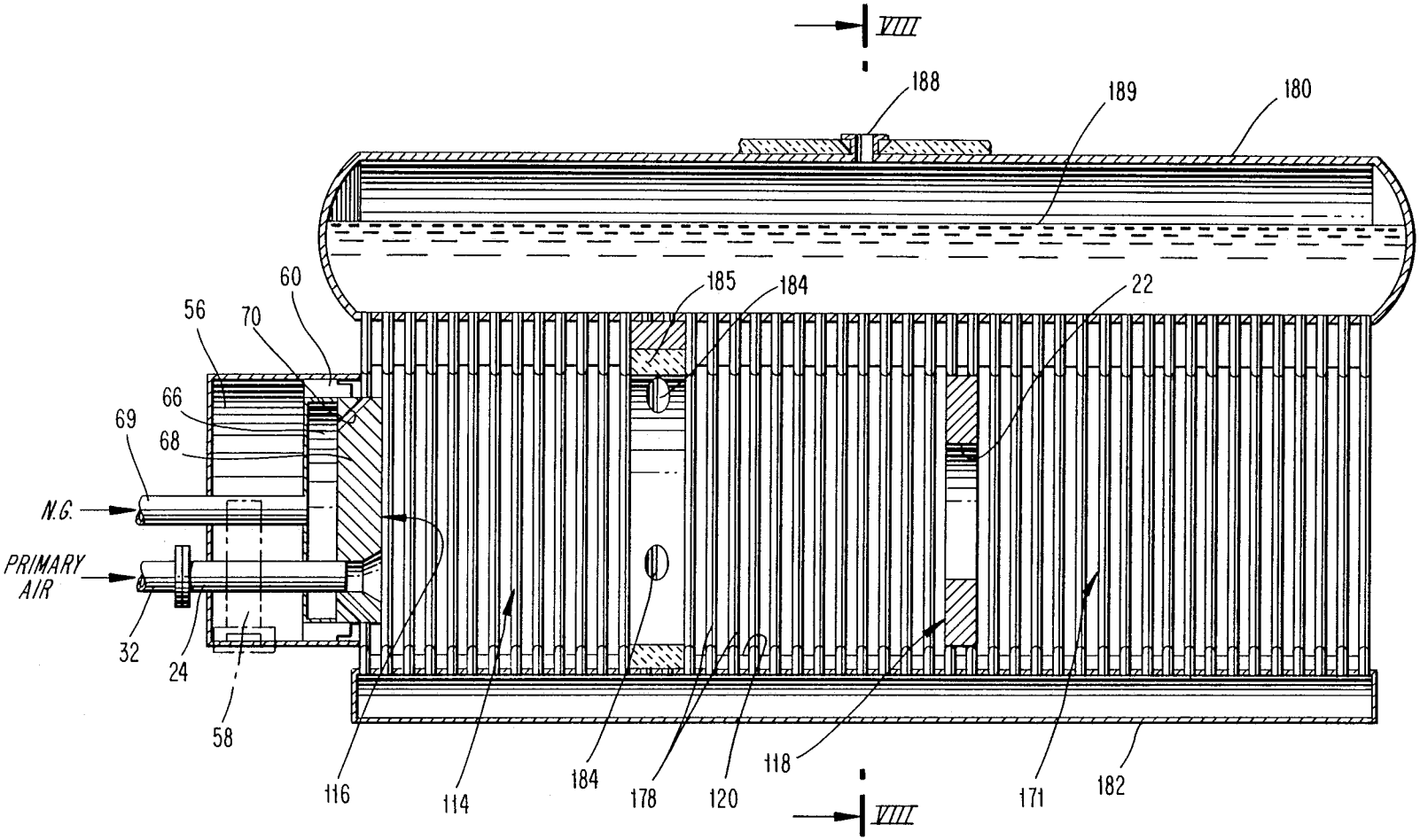
FIG. 6 is a side elevation view in cross-section of a second embodiment of a boiler incorporating the teachings of the present invention.

Heat exchange means surrounds and extends substantially throughout the axial length of combustion chamber 14. As embodied herein, such means comprises water contained in the water jacket (shell) of a fire tube boiler, as shown in FIG. 1, water contained in the tubes of a water tube boiler, as shown in FIG. 6, or one of the other boiler heat exchange embodiments shown in FIGS. 9, 10 and 12. The features of these boiler embodiments will be explained in greater detail below. The heat exchange means cools cylindrical outer wall 20 of combustion chamber 14.

In combustion chamber 14, stable combustion is achieved over a broad range of boiler operating capacities including a very low capacity because stable combustion is provided by jet burner 32 from which partially preburned fuel and hot combustion gases are exhausted into combustion chamber 14. This partially preburned fuel takes the form of vapor when oil is being burned in jet burner 32.

The cooling effect of the heat exchange means on combustion chamber 14 keeps the operating flame temperature within the combustion chamber lower than that in conventional cyclonic combustion chambers, and preferably at a temperature less than 2000° F. when the cyclone combustion chamber is operated at maximum capacity. Because of this reduced temperature, $NO_x$ emissions exhausted from combustion chamber 14 can be reduced to a point where $NO_x$ formation is lower than 50 ppm calculated down or up to 3% oxygen in flue gases. That is, if combustion was performed at 3.5% oxygen, for instance, the percent would be calculated "down"; if the same at 2.5%, then the percent would be calculated "up". In addition, combustion chamber 14 is entirely cooled by the heat exchange means and combustion chamber 14 does not have refractory material so the capital cost of chamber 14 is substantially reduced from that of a conventional cyclonic burner.

According to a preferred embodiment of the invention, a substantially cylindrical cooling chamber extends axially beyond the exit throat from the rear end of the combustion chamber and is substantially longitudinally aligned with the combustion chamber. As embodied herein, a cooling chamber 71 extends from rear end 18 of combustion chamber 14. Outer cylindrical wall 20 of combustion chamber 14 and cooling chamber 71 together form the Morison tube 12 of the boiler embodiment shown in FIG. 1. Cooling chamber 71 is cooled by the heat exchange means in the same manner as combustion chamber 14 is cooled.

The cyclone combustion apparatus described above can be operated in several different modes. When the fuel being supplied to jet burner 32 is gaseous fuel supplied through gas port 41 and annular space 42 (FIG. 5), the mix of jet air and fuel in precombustion chamber 34 of jet burner 32 may be controlled so that the air to gas ratio assures complete stoichiometric combustion either within jet burner 32 alone or in jet burner 32 in combination with combustion chamber 14. At lowest operating capacities air plenum 56 and gas distribution plenum 66 are both turned off. As boiler capacity increases, a supply of secondary air through plenum chamber 56 becomes necessary for cyclonic combustion in combustion chamber 14. In this case gas distribution plenum chamber 66 is turned on so that gas is supplied through nozzles 70 at a rate required to react with the secondary air supplied through plenum chamber 56 so that excess air after combustion in combustion chamber 14 remains and is sustained at a desired level.

In another mode of operation when gaseous fuel is supplied to jet burner 32, the primary air supplied to precombustion chamber 34 is controlled for substoichiometric combustion, that is the fuel to air ratio does not allow for complete stoichiometric combustion. In this mode, secondary air is supplied at all times through plenum chamber 56 to provide for cyclonic combustion in combustion chamber 14. At lowest boiler capacities, gas may also be provided through nozzles 70 at a rate required to keep excess air after combustion in combustion chamber 14 at desired levels.

In another operation mode, when fuel oil is the fuel burned in jet burner 32, the combustion in jet burner 32 is preferably incomplete due to a substoichiometric ratio of primary air to oil. When oil is burned in jet burner 32, secondary air is always supplied by air plenum chamber 56 to combustion chamber 14 to provide for cyclonic combustion. When oil burned in jet burner 32, gas distribution chamber 66 is turned off so that gas is not supplied through nozzles 70. Finally, it is also possible to have simultaneous combustion of gaseous and liquid fuel wherein the above two modes of operation are combined.

Figure 2:
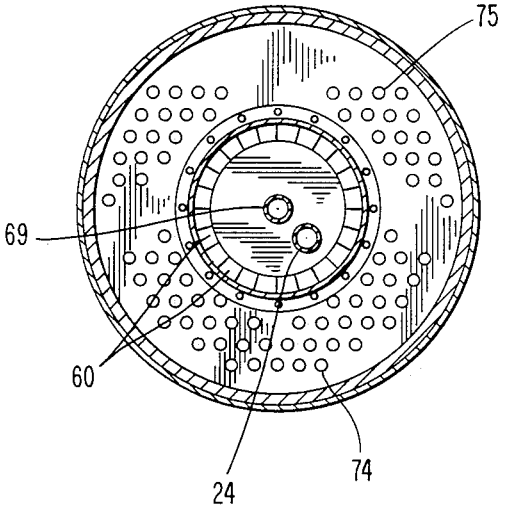
FIG. 2 is a cross-section view taken along the line II—II of FIG. 1.
Figure 3:
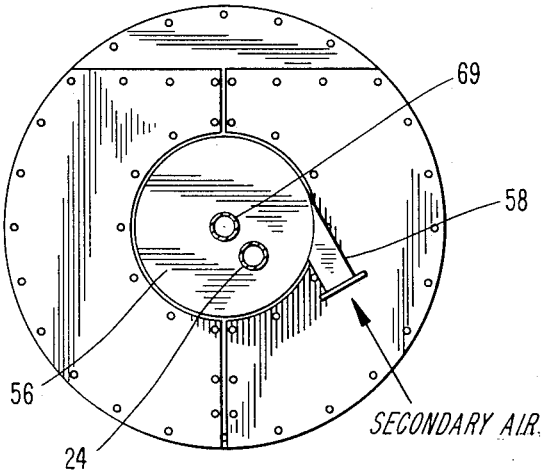
FIG. 3 is a front end view of the boiler illustrated in FIG. 1.

In a preferred embodiment of the invention the heat exchange means surrounding and extending substantially throughout the axial length of the combustion chamber for cooling the wall of the combustion chamber comprises a portion of a fire tube boiler, as shown in FIGS. 1–3. The fire tube boiler includes an outer boiler shell 72, and gas tubes 74 and 75 between outer shell 72 and Morison tube 12. A space 77 within shell 72, outside gas tubes 74, 75 and Morison tube 12 is filled with cooling fluid, typically water, to a fluid level 89. Cooling fluid in space 77 cools cylindrical outer wall 20 of combustion chamber 14 and the outer wall of cooling chamber 71. Steam is exhausted from space 77 through port 88.

Cooling of the combustion chamber decreases combustion flame temperature below 2000° F., as opposed to 3000° F. for conventional fire tube boilers. Because of this lowered temperature and because excess air in combustion chamber 14 can be decreased to 5%, from 25–30% for conventional boilers, and can be kept constant over a high uniform turndown ratio of 10:1, $NO_x$ emissions are lower than is normally the case with standard fire tube boilers and the $NO_x$ emissions reduction from boilers equipped with known cyclonic combustors is even greater.

First plurality of gas tubes 74 and a second plurality of gas tubes 75 extend parallel to the axis of Morison tube 12. First plurality of gas tubes 74 are in communication at one end with an end of cooling chamber 71 and at the opposite end with one end of second plurality of gas tubes 75 that are in turn in communication at their opposite ends with an exhaust flue 55 that exhausts gases from tubes 75. The arrows in FIG. 1 indicate the direction of gas flow, as is conventionally known for fire tube boilers.

According to another embodiment of the invention the heat exchange means surrounding and extending substantially throughout the axial length of the combustion chamber for substantially cooling the wall of the combustion chamber may comprise a portion of a water tube boiler, as shown in FIGS. 6–8. The water tube boiler is useful in that it allows for cyclonic combustion at pressures and boiler capacities greater than can be achieved with fire tube boilers. With increased boiler pressure and capacity in a fire tube boiler, Morison tube 12 experiences an elevation of metal wall skin temperature. This can result in metal stress fatigue that can eventually lead to destruction of the boiler. Accordingly, it may be useful to apply a water tube boiler as a heat exchange means in the cyclone combustion apparatus described above when it is required to design a boiler for high pressure or capacity, or both.

The water tube boiler shown in FIG. 6 includes a cyclone combustion apparatus like the one described above having a cyclone combustion chamber 114 and a cooling chamber 171 on rear end 118 of combustion chamber 114. Combustion chamber 114 and cooling chamber 171 have walls formed from a plurality of cooling tubes 178 extending throughout the axial lengths of combustion chamber 114 and cooling chamber 171. Cooling tubes 178 may be either contiguously joined or spaced from and connected to each other by metal fins to form a continuous wall. Tubes 178 are connected between a steam drum 180, longitudinally extending parallel to and above combustion chamber 114 and cooling chamber 171, and a header 182, longitudinally extending parallel to and below combustion chamber 114 and cooling chamber 171. Steam drum 180 and header 182 are also connected by recirculation tubes 183 which recirculate cooling fluid from steam drum 180 to header 182 (FIG. 8).

In operation cooling tubes 178 are filled with cooling fluid for absorbing heat from combustion chamber 114 and cooling chamber 171. When the cooling fluid absorbs heat, saturated steam is generated which rises into steam drum 180 above a cooling fluid level 189. Steam is exhausted through port 188. Exhaust gases from the outlet of cooling chamber 171 may be transmitted to a convective tube bank which could comprise, for instance, a superheater and economizer, as is conventionally known in the art, for removing heat from the exhaust gases.

According to one embodiment of the invention, tertiary air inlets 184 may be provided in combustion chamber 114. Tertiary air inlets 184 are tangentially aligned with the inner surface of wall 120 of chamber 114 for providing additional cyclonic swirling action within cyclonic combustion chamber 114. As shown in FIG. 6, tertiary air inlets 184 are formed between two groups of cooling tubes 178 in a circumferential portion 185. Portion 185 is preferably formed of a refractory material because cooling tubes do not pass through portion 185.

Supplying tertiary air to combustion chamber 114 allows for greater control of combustion within combustion chamber 114. Further, because tertiary air inlets 184 are axially spaced from front end 116 of combustion chamber 114, excess air in the front end of combustion chamber 114 can be reduced because air for combustion in the rear end of chamber 114 is supplied by tertiary air inlets 184. With this arrangement primary, secondary and tertiary air supplies can be controlled relative to the fuel supply so that combustion in the front end of combustion chamber 114 takes place at substoichiometric conditions. Downstream of tertiary air inlets 184, combustion will be above stoichiometric combustion conditions and reverse flows in combustion chamber 114 will also be above stoichiometric combustion conditions. Thus, combustion in the front portion of combustion chamber 114 is substoichiometric and temperatures are reduced due to cooling of cylindrical wall 120 of combustion chamber 114 by the cooling tubes 178 so that $NO_x$ production is kept low.

Figure 9:
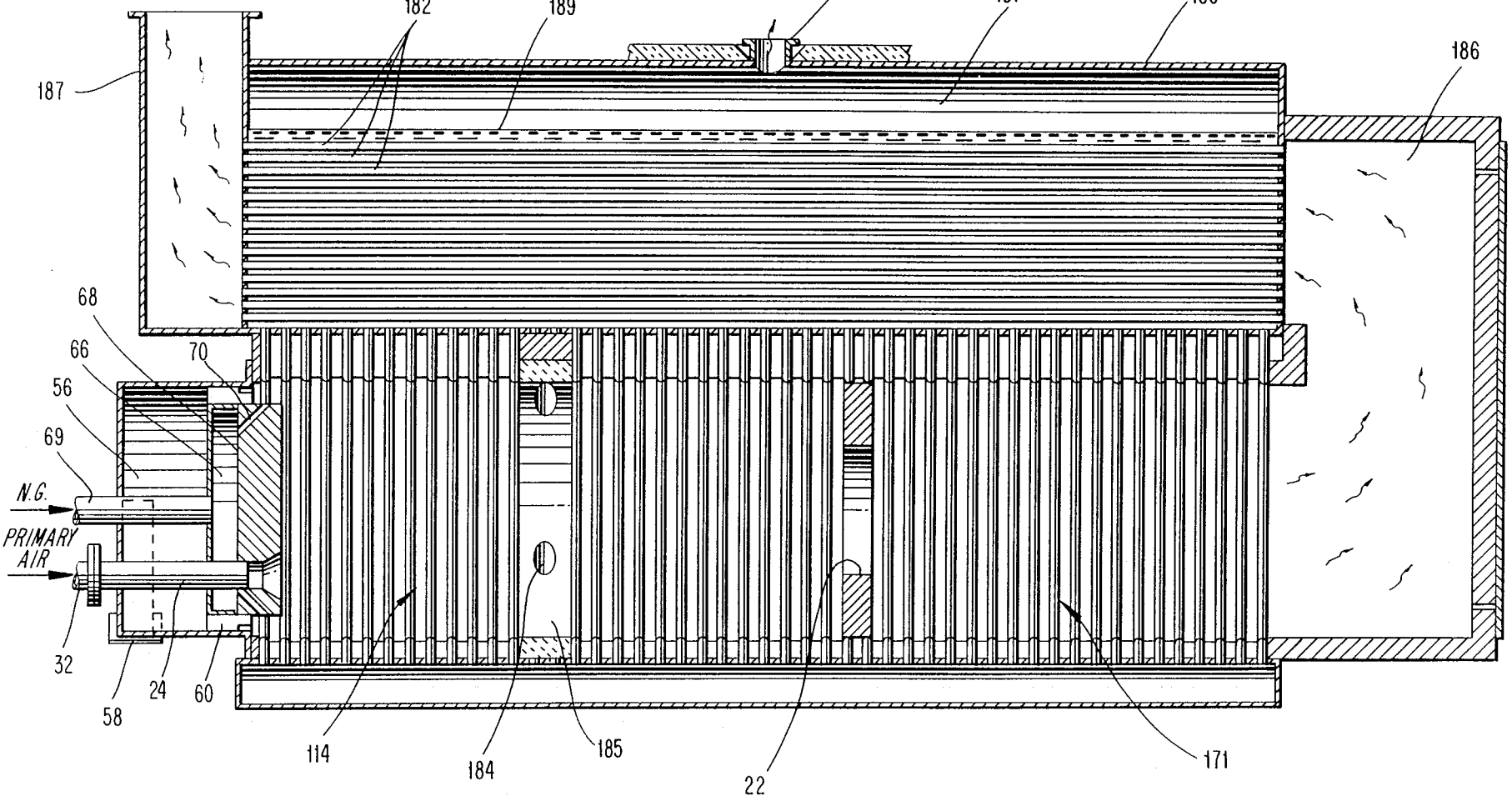
FIG. 9 is a side elevation in cross-section of a third embodiment of a boiler incorporating the teachings of the present invention.

According to another embodiment of the invention, the apparatus shown in FIGS. 6–8 can be modified, as shown in FIG. 9, by including a plurality of spaced gas tubes 182 in an interior portion 181 of steam drum 180. Gas tubes 182 extend along the axial length of steam drum 180 for conducting hot gases from cooling chamber 171 through a turn box 186 and out through a gas exhaust flue 187, as shown by the arrows in FIG. 9. Gas tubes 182 are below cooling fluid level 189 so as to be surrounded by cooling fluid inside steam drum 180. Steam in steam drum 180 above cooling fluid level 189 is exhausted through port 188.

Figure 10:
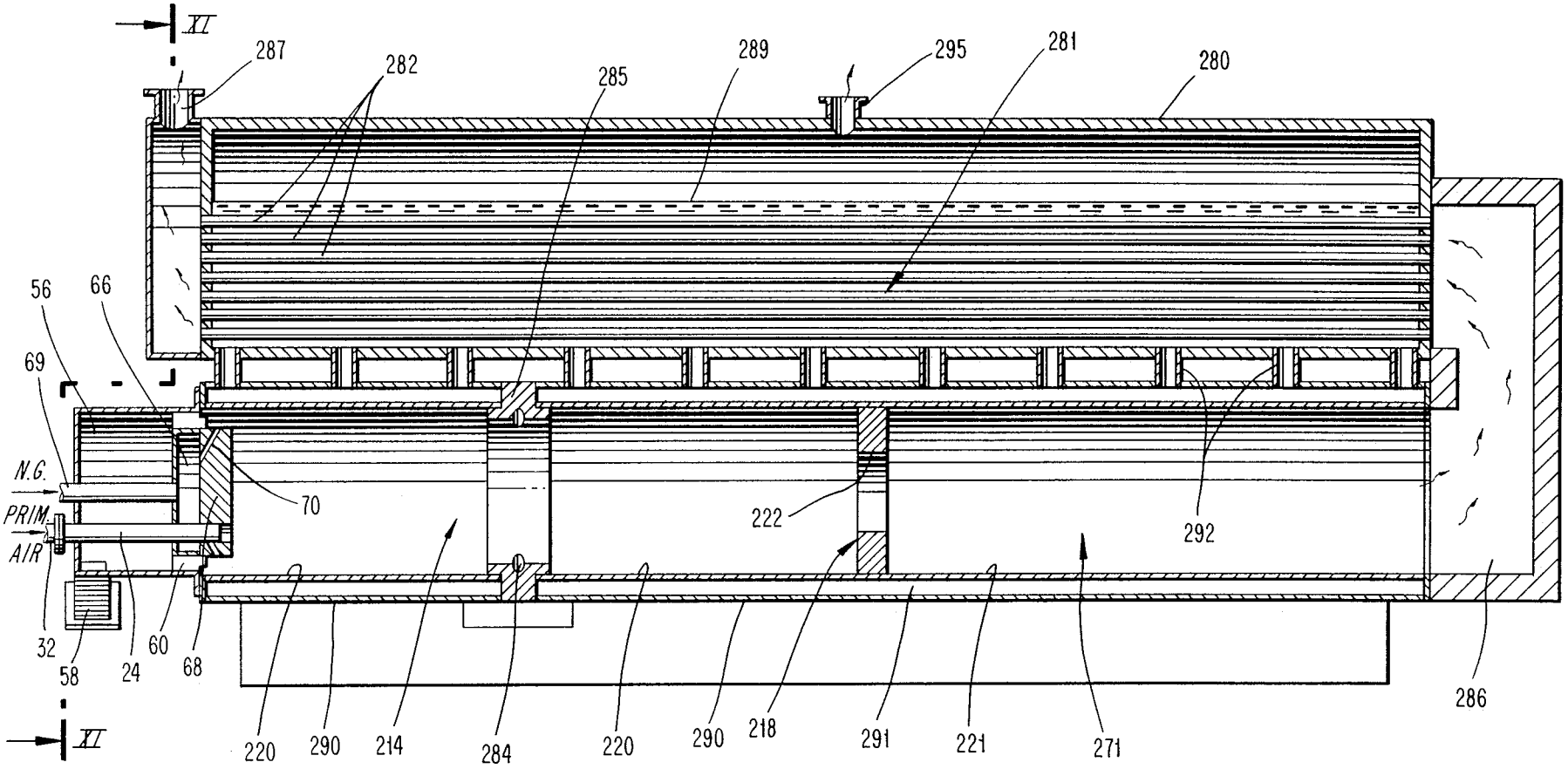
FIG. 10 is a side elevation in cross-section of a fourth embodiment of a boiler incorporating the teachings of the present invention.

According to another embodiment of the invention the heat exchange means surrounding and extending substantially throughout the axial length of the combustion chamber for substantially cooling the wall of the combustion chamber may comprise a portion of a boiler, as shown in FIGS. 10–13. The boiler shown in FIG. 10 includes a cyclone combustion apparatus like the one described above, having a cyclone combustion chamber 214 and a cooling chamber 271 extending from rear end 218 of combustion chamber 214. Combustion chamber 214 and cooling chamber 271 have cylindrical walls 220 and 221, respectively. A jacket 290 is spaced from and surrounds cylindrical walls 220 and 221. The space between jacket 290 and walls 220, 221 defines an annular cooling chamber 291 that is filled with cooling fluid for absorbing heat from the walls of combustion chamber 214 and cooling chamber 271. A plurality of connecting risers 292 connect an interior portion 281 of a steam drum 280 with annular cooling chamber 291. In FIGS. 10–11, recirculation downcomers 294 are shown that connect steam drum 280 and annular cooling chamber 291 along the length of combustion chamber 214 and cooling chamber 271. Heated fluid and formed steam in annular cooling chamber 291 rise into interior portion 281 of steam drum 280 through risers 292. Cooling fluid recirculates through recirculation downcomers 294 into the base of annular cooling chamber 291. Steam above a cooling fluid level 289 is exhausted from steam drum 280 through exhaust port 295. This boiler is best applied where the boiler is to operate at medium to low pressures or capacities, or both.

As was described with respect to the embodiment shown in FIG. 9, the embodiment shown in FIG. 10 includes a plurality of gas tubes 282 extending through the vertical length of interior portion 281 of steam drum 280. Gas tubes 282 function in the same manner as gas tubes 182 of FIG. 9. The embodiment shown in FIG. 10 also includes tertiary air inlets 284 in a circumferential portion 285 that function like the tertiary air inlets 184 of FIG. 6.

Figure 12:
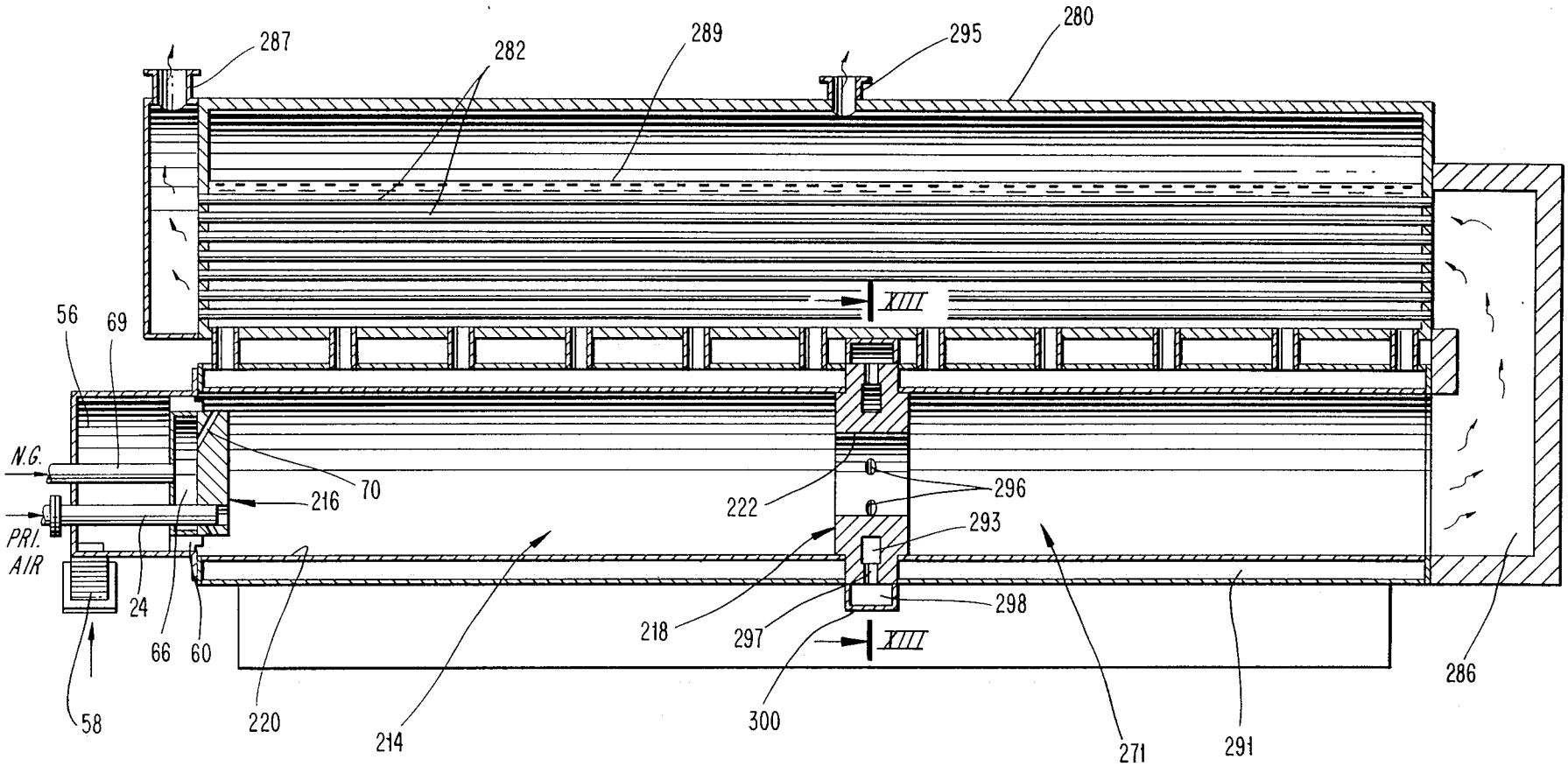
FIG. 12 is a side elevation in cross-section of a fifth embodiment of a boiler incorporating the teachings of the present invention.

The boiler of FIG. 10 may be modified as shown in FIGS. 12 and 13. According to the embodiment of the invention shown in FIG. 12, the apparatus is provided with tangential air inlets 296 in exit throat 222 for supplying tertiary air to exit throat 222. As shown in FIG. 13, tertiary air enters tertiary air chamber 300 through inlet 299 into a first manifold 298. The tertiary air then passes through ports 297 into a second manifold 293 from which the tertiary air enters throat 222 through tangential air inlets 296.

By introducing tertiary air at exit throat 222, combustion in the entire combustion chamber 214 can be performed at substoichiometric combustion conditions and relatively lower temperatures. Thus, the amount of $NO_x$ produced in combustion chamber 214 is reduced. In addition, by tangentially introducing tertiary air into exit throat 222, rotational flow in cooling chamber 271 is increased so that gas velocities along the walls of cooling chamber 271 are also increased causing an increased heat transfer. This increased tangential momentum of the exhaust gases in cooling chamber 271 increases heat transfer to annular cooling chamber 291. With increased heat transfer, gas being exhausted from cooling chamber 271 has a decreased temperature which decreases $NO_x$ emissions.

Tangential air inlets in the exit throat for supplying tertiary air, as described above, can also be advantageously applied to the boiler embodiments shown in FIGS. 6 and 9. Staging air in the manner described with respect to the embodiment shown in FIG. 12 can similarly reduce $NO_x$ emissions in the embodiments shown in FIGS. 6 and 9.

It will be apparent to those skilled in the art that modifications and variations can be made in the cyclonic combustion apparatus of this invention. The invention in its broader aspects is, therefore, not limited to the specific details, respresentative apparatus, and illustrative examples shown and described above. Thus, it is intended that all matter contained in the foregoing description or shown in the accompanying drawings shall be interpreted as illustrative and not in a limiting sense.

What is claimed is:

1. A cyclone combustion apparatus, comprising:

a combustion chamber having a front end, a rear end and a substantially cylindrical wall having an inner surface;

a substantially cylindrical exit throat at the rear end of the combustion chamber and aligned substantially concentrically therewith, for exhausting hot gases from the combustion chamber, the exit throat having a diameter less than the diameter of said inner surface;

means for supplying partially preburned fuel into said combustion chamber from the front end thereof, said means for supplying partially preburned fuel including a precombustion chamber having a fuel inlet and a jet air supply inlet for admitting a desired mixture of fuel and air and an outlet connected to the front end of the combustion chamber for exhausting hot partially burned fuel gases into said combustion chamber;

an annular primary air supply chamber having an annular outlet for discharging a primary air stream surrounding said partially burned fuel gases exhausted into said combustion chamber;

means for supplying secondary air into said combustion chamber and for forming a cyclonic flow pattern of hot gases for combustion within said chamber, said air supply means including a plenum chamber fixed on the front end of the combustion chamber, said plenum chamber having an air inlet and an annular air supply opening in communication with and coaxial with the combustion chamber, said annular air supply opening having spaced radial vanes tilted at a selected angle from the axis of said combustion chamber to affect cyclonic air swirling in the combustion chamber; and heat exchange means surrounding and extending substantially throughout the axial length of the combustion chamber for cooling the wall in the combustion chamber.

2. The apparatus of claim 1 wherein the fuel in the desired mixture of fuel and air is a liquid fuel.

3. The apparatus of claim 1 wherein the fuel in the desired mixture of fuel and air is gaseous fuel.

4. The apparatus of claim 1 further comprising means for injecting gaseous fuel into said annular air outlet.

5. The apparatus of claim 4 wherein the gaseous fuel injecting means includes a gas distribution plenum having a gas inlet pipe and a plurality of outlet nozzles communicating with said annular air supply opening.

6. The apparatus of claim 5 wherein said plenum chamber is cylindrical and is coaxially fixed on the front end of combustion chamber, said plenum chamber air inlets are substantially tangential to said cylindrical plenum chamber and said annular air supply opening has an outer diameter substantially equal to the diameter of the inner surface of said combustion chamber.

7. The apparatus of claim 1 including a substantially cylindrical cooling chamber extending axially beyond the exit throat from the rear end of said combustion chamber and substantially longitudinally aligned with the combustion chamber.

8. The apparatus of claim 7 wherein the combustion chamber, the exit throat and the annular secondary air supply opening are dimensioned and configured to effect a cyclonic flow pattern in the combustion chamber having a Swirl number of at least 0.6 and a Reynolds number of at least 18,000 when said chamber is operated at maximum capacity.

9. The apparatus of claim 1 wherein said heat exchange means is operative to provide a flame temperature in the combustion chamber that is less than about 2000° F. when the cyclone combustion chamber is operated at maximum capacity.

10. The apparatus of claim 1 further comprising a tangential air inlet in the wall of said combustion chamber between said front and rear ends for supplying tertiary air to said combustion chamber.

11. The apparatus of claim 13 further comprising a tangential air inlet in said exit throat for supplying tertiary air to said exit throat and said cylindrical exhaust portion.

12. A cyclone combustion apparatus for a fire tube boiler comprising:

a combustion chamber having a front end, a rear end and a substantially cylindrical longitudinally extending wall having an inner surface and an outer surface, said combustion chamber comprising a portion of the boiler fire tube;

means for supplying partially preburned fuel into said combustion chamber from the front end thereof, said means for supplying partially preburned fuel including a precombustion chamber having a fuel inlet and a jet air supply inlet for admitting a desired mixture of fuel and air and an outlet connected to the front end of the combustion chamber for exhausting hot partially burned fuel gases into said combustion chamber;

an annular primary air supply chamber having an annular outlet for discharging a primary air stream surrounding said partially burned fuel gases exhausted into said combustion chamber;

means for supplying secondary air into said combustion chamber and for forming a cyclonic flow pattern of hot gases for combustion within said chamber, said air supply means including a plenum chamber fixed on the front end of the combustion chamber, said plenum chamber having an air inlet and an annular air supply opening in communication with and coaxial with the combustion chamber, said annular air supply opening having spaced radial vanes tilted at a selected angle from the axis of said combustion chamber to affect cyclonic air swirling in the combustion chamber;

a substantially cylindrical exit throat at the rear end of the combustion chamber and aligned substantially concentrically therewith for exhausting hot gases from the combustion chamber, the exit throat having a diameter less than the diameter of the inner surface of the chamber wall; and heat exchange means surrounding and extending substantially throughout the axial length of the combustion chamber for cooling the wall of the combustion chamber and for absorbing heat from the hot gases exhausted from said exit throat, the heat exchange means including an outer shell surrounding said combustion chamber, a plurality of spaced gas tubes disposed between said outer shell and the combustion chamber for conducting hot gases from the combustion chamber, said heat exchange means including a space within the shell exterior of the gas tubes and said outer surface of the combustion chamber for containing a cooling fluid.

13. The apparatus of claim 12 including a substantially cylindrical cooling chamber extending axially beyond the exit throat from the rear of the combustion chamber and substantially longitudinally aligned with the combustion chamber, said exhaust portion also being surrounded by said outer shell, said plurality of spaced gas tubes and said cooling fluid.

14. The apparatus of claim 13 wherein said plurality of gas tubes includes a first and second plurality of gas tubes extending parallel to the axis of said combustion chamber, said first plurality of gas tubes being in communication at one end with an end of the exhaust portion and at the opposite end with one end of the second plurality of tubes, said second plurality being in communication at the other end with an exhaust flue for exhausting the gases within the tubes.

15. The apparatus of claim 13 wherein said plurality of gas tubes extend parallel to the axis of said combustion chamber, said plurality of gas tubes being in communication at one end with an end of the cooling chamber and at the other end with an exhaust flue for exhausting the gases within the tubes.

16. The apparatus of claim 13 wherein the heat exchange means includes means for directing the flow of hot gases from the cylindrical cooling chamber through the gas tubes.

17. The apparatus of claim 16 wherein the gas tubes of the heat exchange means longitudinally extend parallel to the axes of the combustion chamber and the substantially cylindrical cooling chamber.

18. A cyclone combustion apparatus for a water tube boiler comprising:

a combustion chamber having a front end, a rear end and a substantially cylindrical longitudinally extending wall having an inner surface, said combustion chamber comprising a portion of the boiler water tube;

means for supplying partially preburned fuel into said combustion chamber from the front end thereof, said means for supplying partially preburned fuel including a precombustion chamber having a fuel inlet and a jet air supply inlet for admitting a desired mixture of fuel and air and an outlet connected to the front end of the combustion chamber for exhausitng hot partially burned fuel gases into said combustion chamber;

an annular primary air supply chamber having an annular outlet for discharging a primary air stream surrounding said partially burned fuel gases exhausted into said combustion chamber;

means for supplying secondary air into said combustion chamber and for forming a cyclonic flow pattern of hot gases for combustion within said combustion chamber, said air supply means including a plenum chamber fixed on the front end of the combustion chamber, said plenum chamber having an air inlet and an annular air supply opening in communication with and coaxial with the combustion chamber, said annular air supply opening having spaced radial vanes titled at a selected angle from the axis of said combustion chamber to affect cyclonic air swirling in the combustion chamber;

a substantially cyclindrical exit throat at the rear end of the combustion chamber and aligned substantially concentrically therewith for exhausting hot gases from the combustion chamber, the exit throat having a diameter less than the diameter of the inner surface of the combustion chamber wall; and heat exchange means surrounding and extending substantially throughout the axial length of the combustion chamber for cooling the wall of the combustion chamber, the heat exchange means including a steam drum longitudinally extending parallel to and above said combustion chamber, a header longitudinally extending parallel to and below said combustion chamber, a plurality of tubes connecting said header and steam drum, said tubes being integral with said combustion chamber wall along the length of said combustion chamber on opposite sides of said chamber, said tubes filled with cooling fluid for absorbing heat from said chamber to produce steam that is exhausted from said steam drum.

19. The apparatus of claim 18 including a substantially cylindrical cooling chamber extending from the rear of the combustion chamber and substantially longitudinally aligned with the combustion chamber.

20. The apparatus of claim 19 wherein said steam drum, said header and said plurality connecting tubes extend throughout the axial length of said combustion chamber and said substantially aligned cylindrical cooling chamber, and said tubes contigously form the walls of said combustion chamber and of said substantially cylindrical cooling chamber for absorbing heat from said combustion chamber and cooling chamber.

21. The apparatus of claim 19 wherein said steam drum, said header and said plurality of semicircular connecting tubes extend throughout the axial length of said combustion chamber and said substantially aligned cylindrical cooling chamber, and said tubes are spaced from or close to each other and integral with said combustion chamber wall and cooling chamber wall for absorbing heat therefrom.

22. The apparatus of claim 20 further comprising a plurality of spaced gas tubes extending in an interior portion of the steam drum along the axial length of the steam drum for conducting hot gases from the exhaust portion, said gas tubes being surrounded by cooling fluid and steam in said steam drum, said gas tubes each having a first end in communication with an end of the exhaust portion and having an opposite second end in communication with an exhaust flue for exhausting the gases within the gas tubes.

23. The apparatus of claim 19 further comprising a tangential air inlet in the wall of said combustion chamber between said front and rear ends for supplying tertiary air to said combustion chamber.

24. A cyclone combustion apparatus for a boiler comprising:

a combustion chamber having a front end, a rear end and a substantially cylindrical longitudinally extending wall having an inner and an outer surface, said combustion chamber comprising a portion of the boiler;

means for supplying partially preburned fuel into said combustion chamber from the front end thereof, said means for supplying partially preburned fuel including a precombustion chamber having a fuel inlet and a jet air supply inlet for admitting a desired mixture of fuel and air and an outlet connected to the front end of the combustion chamber for exhausting hot partially burned fuel gases into said combustion chamber;

an annular primary air supply chamber having an annular outlet for discharging a primary air stream surrounding said partially burned fuel gases exhausted into said combustion chamber;

means for supplying secondary air into said combustion chamber and for forming a cyclonic flow pattern of hot gases for combustion within said combustion chamber; said air supply means including a plenum chamber fixed on the front end of the combustion chamber, said plenum chamber having an air inlet and an annular air supply opening in communication with and coaxial with the combustion chamber, said annular air supply opening having spaced radial vanes tilted at a selected angle from the axis of said combustion chamber to affect cyclonic air swirling in the combustion chamber;

a substantially cylindrical exit throat at the rear end of the combustion chamber and aligned substantially concentrically therewith for exhausting hot gases from the combustion chamber, the exit throat having a diameter less than the diameter of the inner surface of the combustion chamber wall; and heat exchange means surrounding and extending substantially throughout the axial length of the combustion chamber for cooling the wall of the combustion chamber, the heat exhange means including a steam drum longitudinally extending parallel to and above the combustion chamber, a jacket spaced from and surrounding said combustion chamber wall, said jacket and combustion chamber wall defining an annular cooling chamber filled with cooling fluid for absorbing heat from said chamber, a plurality of connecting pipes connecting said steam drum with said annular cooling chamber, said connecting pipes spaced from each other above and along the axial length of said combustion chamber, and a plurality of recirculating pipes connecting said steam drum with said annular cooling chamber at said combustion chamber bottom.

25. The apparatus of claim 24 including a substantially cylindrical cooling chamber extending from the rear of the combustion chamber and substantially longitudinally aligned with the combustion chamber.

26. The apparatus of claim 25 wherein said steam drum, said jacket and said connecting pipes extend throughout the axial length of said combustion chamber and said substantially aligned cylindrical cooling chamber for absorbing heat therefrom.

27. The apparatus of claim 26 further comprising a tangential air inlet in said exit throat for supplying tertiary air to said exit throat.

28. The apparatus of claim 26 further comprising a tangential air inlet in the wall of said combustion chamber between said front and rear ends for supplying tertiary air to said combustion chamber.

* * * * *